US005579689A

United States Patent [19]

Ohinata et al.

[11] Patent Number: 5,579,689

[45] **Date of Patent: *Dec. 3, 1996**

[54] PRINTING DRUM OF ROTARY STENCIL PRINTER HAVING A PREDETERMINED ALLOWANCE FOR BULGING OUT

[75] Inventors: Yoshihara Ohinata; Nagon Takita; Hideo Negishi, all of Tokyo, Japan

[73] Assignee: Riso Kagaku Corporation, Tokyo, Japan

[ * ] Notice: The term of this patent shall not extend beyond the expiration date of Pat. No. 5,555,802.

[21] Appl. No.: 332,074

[22] Filed: Nov. 1, 1994

[30] Foreign Application Priority Data

Nov. 12, 1993 [JP] Japan ..... 5-306027

[51] Int. Cl.[6] ..... B41L 13/00; B41L 13/04; B41L 13/06

[52] U.S. Cl. ..... 101/120; 101/116; 101/119; 101/127

[58] Field of Search ..... 101/116, 114, 101/120, 127, 127.1, 128, 128.1, 174, 211, 129, 119

[56] References Cited

U.S. PATENT DOCUMENTS

| | | | |
|---|---|---|---|
| 3,811,378 | 5/1974 | Bohm | 101/120 |
| 4,026,208 | 5/1977 | Horne, Jr. et al. | 101/116 |
| 4,911,069 | 3/1990 | Hayama et al. . | |
| 5,090,312 | 2/1992 | Ohinata | 101/120 |
| 5,255,599 | 10/1993 | Kobayashi et al. | 101/119 |

FOREIGN PATENT DOCUMENTS

| | | |
|---|---|---|
| 1204781 | 8/1989 | Japan . |
| 2225078 | 9/1990 | Japan . |

*Primary Examiner*—Edgar S. Burr
*Assistant Examiner*—Daniel J. Colilla
*Attorney, Agent, or Firm*—Watson Cole Stevens Davis, P.L.L.C.

[57] ABSTRACT

A printing drum for a rotary stencil printer having a sidewall in the form of a flexible perforated sheet. In order to allow for a bulging out deformation of the sidewall by an internal press roller to be easier and more uniform over the entire width of the printing, the flexible cylindrical body of the printing drum has its opposite side edge portions seated around the outer circumferential surfaces of a pair of annular portions (10*a*, 10*b*). The drum is constructed to have an inner circumferential length greater than the circumferential length of the outer circumferential surface of the annular portions by a predetermined amount which allows for a predetermined bulging out deformation of the flexible cylindrical body.

3 Claims, 4 Drawing Sheets

PRINTING DRUM OF ROTARY STENCIL PRINTER HAVING A PREDETERMINED ALLOWANCE FOR BULGING OUT

BACKGROUND OF THE INVENTION

1. Field of the Invention

The present invention relates to a rotary stencil printer, and more particularly to the construction of a printing drum thereof.

2. Description of the Prior Art

In order for a rotary stencil printer to quickly start up to operate normally after the start thereof such that high quality prints are available from the first or second print with almost no trial printing, and in view of the matter that, in a rotary stencil printer wherein each printing paper is pressed between a printing drum and a back press roller for each printing, while the printing drum and the back press roller must be retracted from one another at each interval between two successive supplies of printing sheets, either the printing drum or the back press roller each having a substantial mass must inevitably be frequently reciprocated, thereby substantially restricting an increase of printing speed, it has been proposed in Japanese Patent Application 63-28553 (Laid-open Publication 1-204781) by the same assignee as that of the present application to construct a rotary stencil printer such that a principal portion of the printing drum extending between opposite axial ends thereof to support a stencil sheet wrapped therearound is constructed by a flexible perforated sheet, instead of the conventional printing drum entirely made of a rigid cylindrical body, whereby a part of the cylindrical body is bulged radially outwardly by an internal press roller adapted to rotate along the inner surface of the cylindrical body, such that, according to a rotation of the printing drum in the printing operation, each portion of the flexible cylindrical body opposing the back press roller is successively bulged out by the internal press roller so as to apply a stencil printing to a printing sheet pressed between the bulged out portion of the flexible cylindrical body and the back press roller. Further, as an improvement of such a rotary stencil printer, it has also been proposed in Japanese Patent Application 1-47029 (Laid-open Publication 2-225078) by the same assignee as that of the present application to construct a printing drum such that the above-mentioned flexible cylindrical body is provided by a flexible perforated sheet having a rectangular configuration in development, said flexible perforated sheet being mounted around two annular portions forming opposite axial end portions of the printing drum with opposite side edge portions thereof being slidably seated on the outer circumferential surfaces of the two annular portions.

When the above-mentioned flexible perforated sheet is a net-like sheet made of woven or non woven or knitted fibrous materials, and when such a sheet cylindrically wound with opposite end portions thereof seated around the outer circumferential surfaces of the two annular portions is pressed radially outwardly at an axially internal portion thereof by the internal press roller, the flexible perforated sheet is bulged radially outwardly substantially uniformly over the entire axial length or width thereof contacted by the internal press roller such that a stencil print is available to have a uniform quality over the entire region of width. In this respect, when the opposite side edge portions of the flexible perforated sheet having a rectangular configuration in development are freely seated around the outer circumferential surfaces of the annular portions as arranged according to the afore-mentioned improvement, the cylindrical body shows a higher flexibility so that a higher uniformity is available in the radially outward bulging out thereof under the action of the internal press roller.

However, in order that the cylindrical body is more uniformly bulged radially outwardly by the internal press roller over the entire region of the width thereof, and in order that the printing speed is further increased, it is desired that the cylindrical body has a construction which allows for a more light and uniform bulging out thereof in response to the radially outward pressing action by the internal press roller.

SUMMARY OF THE INVENTION

In view of the above circumstances, it is an object of the present invention to provide a more improved printing drum of a rotary stencil printer which affords a lighter and more uniform bulging out in response to the radially outward pressing action by the internal press roller applied to the inside of the cylindrical body of the drum constructed by a flexible perforated sheet.

According to the present invention, the above-mentioned object is accomplished by a printing drum of a rotary type stencil printer in which said printing drum has a cylindrical body of a perforated construction adapted for carrying a perforated stencil sheet wrapped therearound, and ink supplied to the inside of said cylindrical body is supplied to said stencil sheet through perforations of said cylindrical body due to urging by an internal press roller adapted to rotate along an internal surface of said cylindrical body, wherein a part of said cylindrical body is bulged radially outwardly by said internal press roller as much as a predetermined substantial bulge out amount, while said printing drum rotates with a print sheet being pressed against said cylindrical body thereof by a back press means such that a stencil printing is applied onto the printing sheet, said printing drum having a frame body including two annular portions forming opposite end portions thereof and a transverse bar portion connecting said two annular portions with one another and equipped with a stencil sheet leading end mounting means for selectively mounting a leading end of a stencil sheet, and a flexible perforated sheet of a rectangular configuration in development with opposite side edge portions thereof being adapted to freely seat on outer circumferential surfaces of said two annular portions thus constructing a principal portion of said cylindrical body, characterized in that the inside circumferential length of said cylindrical body is greater than the circumferential length of said outer circumferential surfaces of said annular portions by a length which corresponds to a clearance therebetween for allowing said predetermined bulge out amount.

The flexible perforated sheet may be mounted to said transverse bar portion at opposite ends thereof as viewed in said rectangular development such that a portion of said cylindrical body is constructed by said transverse bar portion. The mounting of said opposite ends of the flexible perforated sheet to said transverse bar portion may be a firm fastening, or may be a pivotal mounting at least at one of said opposite ends, provided that said opposite ends are restricted against circumferential movement relative to said transverse bar portion. Or, alternatively, said cylindrical body may be constructed by the flexible perforated sheet entirely through the circumference thereof. Cushion elements may be mounted between the outer circumferential surfaces of said annular portions and the opposite side edge portions of the flexible perforated sheet.

The printing drum according to the present invention does not necessarily need a roller as a cooperating means for supporting the back of a printing sheet pressed against thereto, but other printing sheet back pressing means such as a plain plate, arcuate plate or the like having a highly slidable surface may be used therewith.

The flexible perforated sheet may be a sheet woven or knitted from fibers or other fibrous materials, a sheet made of non woven fiber or other fibrous materials, a plastic or metal sheet formed with a number of small openings, etc., constructed in a single layer or a composite layer, arranged to have an appropriate permeability to ink and an appropriate flexibility.

According to the above-mentioned construction wherein the cylindrical body substantially constructed by the flexible perforated sheet has originally an inner circumferential length greater than the circumferential length of the outer circumferential surfaces of the annular portions by a predetermined length which is required for the bulging out, the clearance due to the difference in the diameters of the two mating members is generally uniformly distributed over the entire circumference according to the elasticity of the flexible perforated sheet when the bulging out is not applied to the cylindrical body, and when any portion of the cylindrical body is applied with the radially outward pressing action by the internal press roller, the clearance distributed over the entire circumference is swiftly collected toward the pressed out portion such that the cylindrical body is more readily bulged radially outwardly at the pressed portion.

For example, assuming that the outer diameter of the annular portions is 150 mm and the outer diameter of the internal press roller is 50 mm, the inner diameter of the cylindrical body to be originally provided for allowing a 3 mm bulging out by the internal press roller is 150.40 mm, and therefore the clearance, when distributed over the entire circumference between the cylindrical body and the annular portions is a minute value such as 0.2 mm.

According to the above-mentioned construction of the present invention the uniformity of printing is more improved along the length as well as the width of the prints, and further the printing speed of the printer can be further increased by being supported by the easier deformation of the cylindrical body.

BRIEF DESCRIPTIONS OF THE DRAWING

In the accompanying drawing,

FIGS. 1*a* and 1*b* are diagmmmatical views showing the basic construction of the rotary stencil printer employing a printing drum formed of a flexible cylindrical body in two different operating conditions;

Figure 4A:
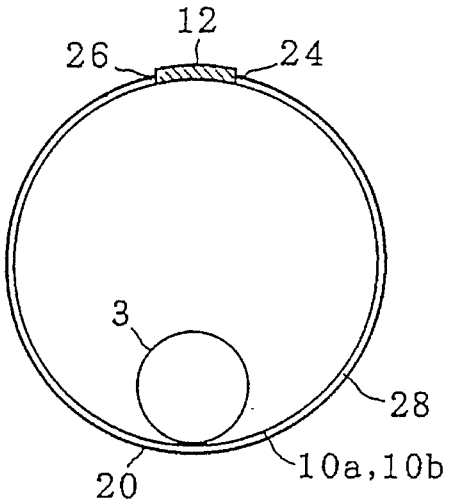
Figure 4B:
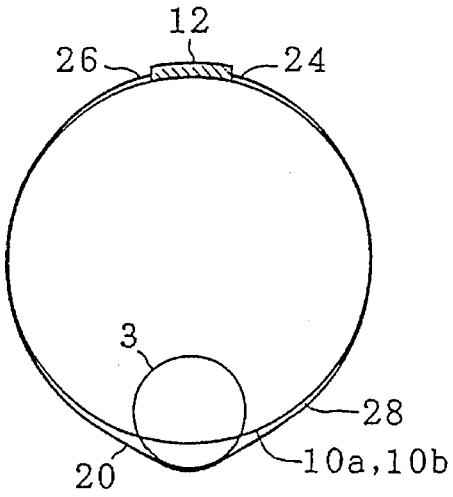
Figure 5A:
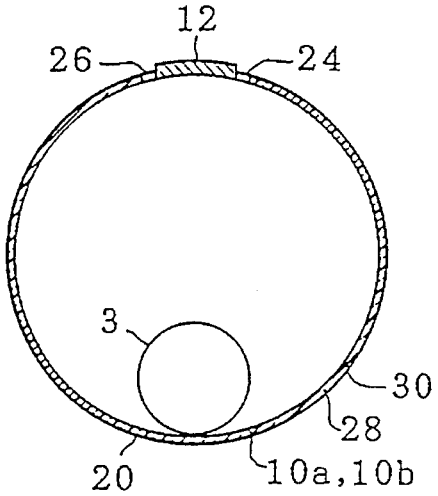
Figure 5B:
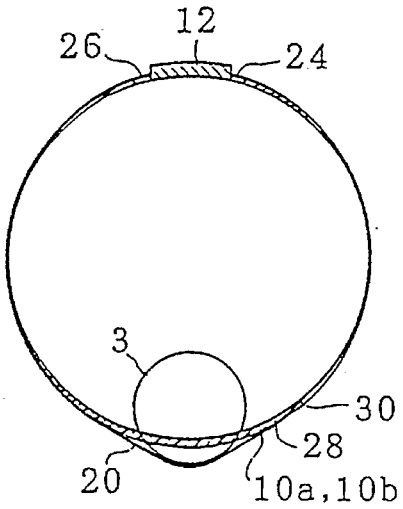
Figure 6A:
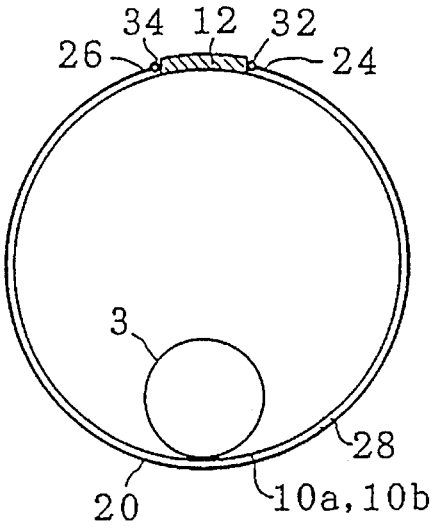
Figure 6B:
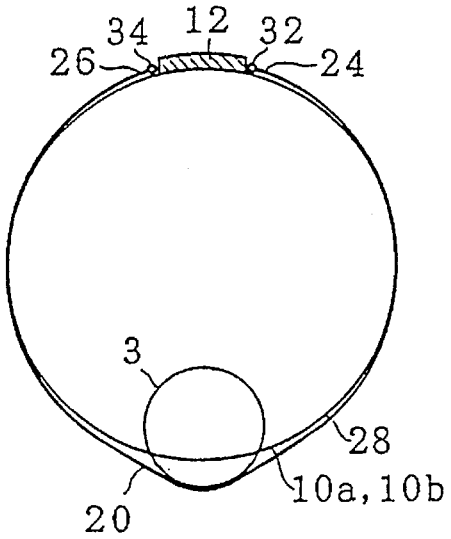

FIGS. 4*a* and 4*b* are diagmmmatical views showing an embodiment of the printing drum according to the present invention in two operating conditions related to the internal press roller;

FIGS. 5*a* and 5*b* are diagmmmatical views showing still another embodiment of the printing drum according to the present invention in two operating conditions related with the internal press roller;

FIGS. 6*a* and 6*b* are views similar to FIGS. 4*a* and 4*b*, showing a modification of the embodiment shown in FIGS. 4*a* and 4*b;*

Figure 7A:
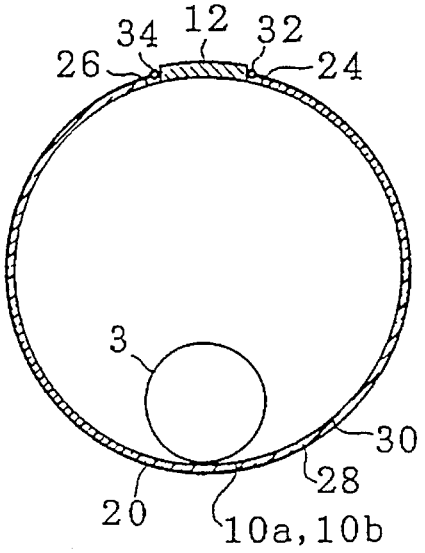
Figure 7B:
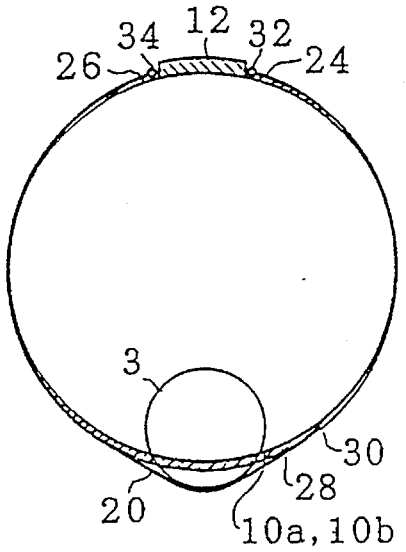

FIGS. 7*a* and 7*b* are views similar to FIGS. 5*a* and 5*b*, showing a modification of the embodiment shown in FIGS. 5*a* and 5*b;*

Figure 8:
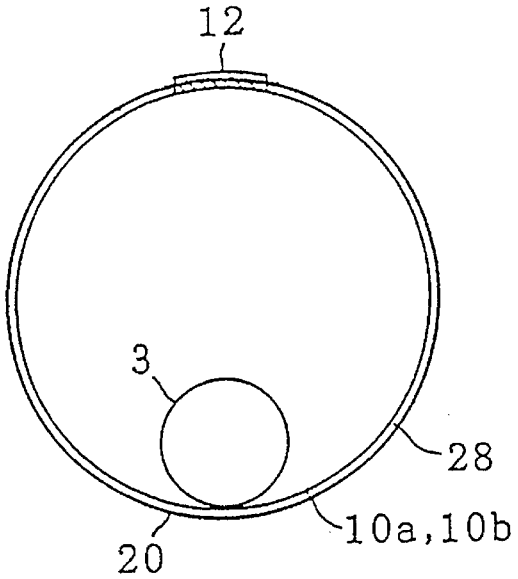
Figure 9:
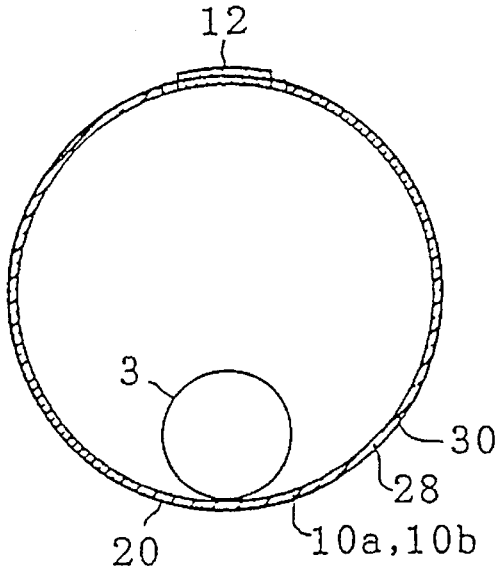

FIG. 8 is a diagmmmatical view similar to FIG. 4*a*, showing still another embodiment of the printing drum according to the present invention; and FIG. 9 is a diagmmmatical view similar to FIG. 5*a*, showing still another embodiment of the printing drum according to the present invention.

DESCRIPTION OF THE PREFERRED EMBODIMENTS

In the following the present invention will be described in more detail with respect to some embodiments in reference to the accompanying drawing.

Figure 1A:
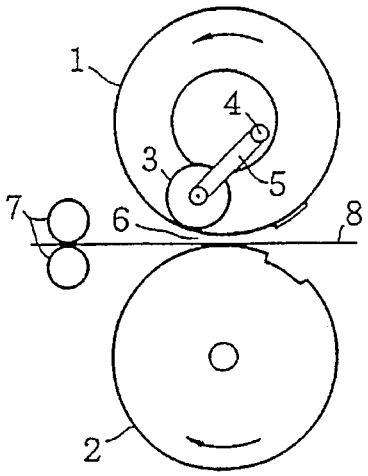
Figure 1B:
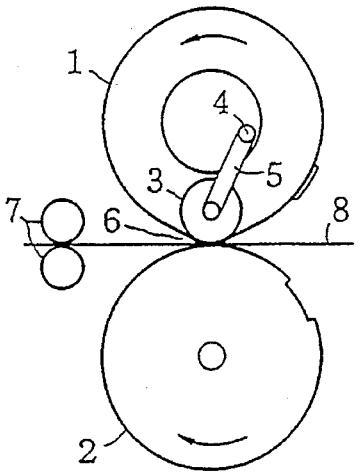

FIGS. 1*a* and 1*b* attached hereto show diagrammatically the basic construction of a rotary stencil printer concerned with the present invention in which the printing drum is essentially constructed by a flexible perforated sheet. The basic construction of the rotary stencil printer shown in these figures is the same as those shown in the afore-mentioned Japanese Patent Applications 63-28553 and 1-47029. In FIGS. 1*a* and 1*b*, a portion designated by reference numeral 1 is a printing drum, a portion designated by reference numeral 2 is a back press roller, and a portion designated by reference numeral 3 is an internal press roller. The cylindrical portion of the printing drum 1, except opposite end portions thereof, is constructed of a flexible perforated sheet, and when the internal press roller 3 rotatably supported by arm members 5 adapted to pivot about a pivot axis 4 is retreated inwardly of the natural cylindrical shape of the printing drum 1 as shown in FIG. 1*a*, the outer circumferential surface of the printing drum 1 is distant from the back press roller 2 so as to leave a clearance 6 therebetween, whereas when the arm members 5 are turned in the anticlockwise direction as viewed in the figure about the pivot axis 4 as shown in FIG. 1*b*, the internal press roller 3 pushes a corresponding portion of the cylindrical body of the printing drum constructed of the flexible perforated sheet radially outwardly so as to press a printing sheet 8 between the bulged out portion and the back press roller 2, said printing sheet being fed into the clearance 6 by a pair of feed rollers 7, whereby the printing sheet 8 is provided with a stencil printing according to a stencil image of a perforated stencil sheet wrapped around the printing drum 1.

Figure 2:
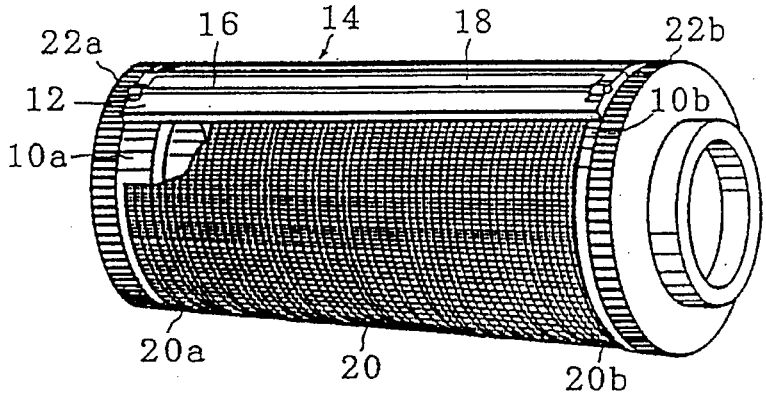
FIG. 2 is a perspective view showing an example of a printing drum in which the flexible perforated sheet constructing the flexible cylindrical body is made of a net woven from a wire material.

FIG. 2 is a perspective view showing the printing drum 1 in an isolated condition. The construction of the printing drum shown in FIG. 2 is the same as the basic construction proposed by the aforementioned Japanese Patent Application 1-47029, and comprises a frame including two annular portions 10*a* and 10*b* constructing opposite axial end portions of the printing drum and a transverse bar portion 12 connecting these two annular portions with one another. The transverse bar portion 12 is equipped with a stencil sheet leading end mounting means 14 for selectively mounting a leading end of a stencil sheet thereto. In the shown embodiment, the stencil sheet leading end mounting means 14 comprises a flip 18 adapted to pivot by means of a shaft 16 for about 180° around the axis of the pivot shaft and adapted to selectively clamp a leading end of a stencil sheet between itself and the transverse bar portion 12 for a selective mounting of the leading end of the stencil sheet to the transverse bar portion 12.

A flexible perforated sheet 20 having a rectangular configuration in development is rounded into a cylindrical configuration with opposite side edge portions 20*a* and 20*b* freely seated around the outer circumferential surfaces of the annular portions 10*a* and 10*b* so as thereby to construct a cylindrical body of a printing drum. Although not shown in detail in FIG. 2, in the printing drum proposed by the afore-mentioned Japanese Patent Application 1-47029, the leading end portion of the flexible perforated sheet 20 as viewed in the direction of rotation of the printing drum is fastened to the transverse bar portion 12, while a trailing end portion thereof is mounted such that it is applied with a tension load by spring means. In the printing drum construction shown in FIG. 2, the flexible perforated sheet 20 is a net material woven from a wire material.

The annular portions 10*a* and 10*b* are integrally formed with gear wheels 22*a* and 22*b*, respectively. These gear wheels are meshed with corresponding gear wheels provided at opposite axial end portions of the back press roller 2 or pinions installed in the printer but not shown in the figure, serving to rotationally drive the printing drum.

Figure 3:
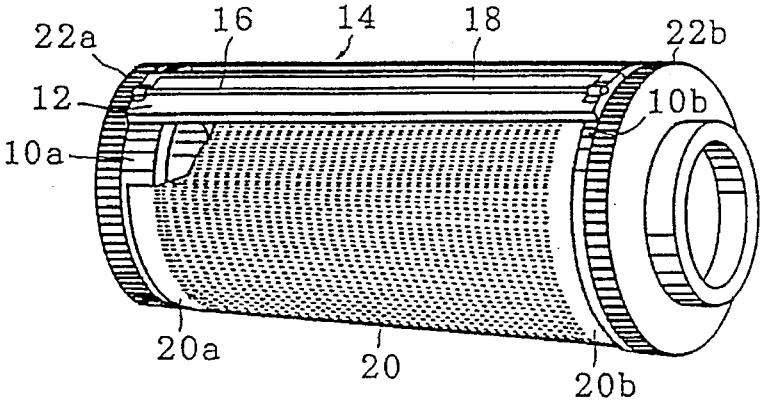
FIG. 3 is a perspective view showing an example of a printing drum in which the flexible perforated sheet constructing the flexible cylindrical body is a sheet material made of a metal plate formed with small holes.

FIG. 3 is a perspective view similar to FIG. 2, showing a printing drum having substantially the same construction as the printing drum shown in FIG. 2. However, in the printing drum shown in FIG. 3 the flexible perforated sheet 20 is made of an elastic thin metal plate formed to have a perforated construction by a number of small openings formed at a middle portion excluding opposite side edge portions thereof. In FIG. 3 the portions corresponding to those shown in FIG. 2 are designated by the same reference numerals.

An embodiment of incorporation of the present invention into the printing drum having the above-mentioned basic construction is shown in FIGS. 4*a* and 4*b* in a diagmmmatical illustration of an essential portion thereof for the clarity of illustration.

In the shown embodiment, the flexible perforated sheet 20 is directly fixed to the transverse bar portion 12 at opposite end portions 24 and 26 positioned adjacent thereto such that the cylindrical body constructed essentially by the flexible perforated sheet 20 (although a part of the cylindrical body is provided by the transverse bar portion 12 in this construction) has an inner circumferential length greater than the outer circumferential length of the annular portions 10*a* and 10*b* by a predetermined amount which is required for the bulging out of the cylindrical body. In the condition shown in FIG. 4*a*, the clearance 28 due to the difference in the circumferential length of the aforementioned two portions is uniformly distributed over the entire circumference. Although the clearance 28 is exaggerated in the figure for the purpose of clarity of illustration, the actual magnitude thereof is very small such as 0.2 mm in the afore-mentioned example that the outer diameter of the annular portions 10*a* and 10*b* is 150 mm and the outer diameter of the internal press roller 3 is 50 mm.

FIG. 4*b* shows a condition that a part of the cylindrical body essentially constructed by the flexible perforated sheet 20 has been bulged radially outwardly by a radially outward biasing of the internal press roller 3. As will be appreciated, the margin for the bulging out of the flexible perforated sheet 20 at the portion pushed by the internal press roller 3 is readily available the clearance 28 being cancelled. Since the opposite side edge portions of the flexible perforated sheet 20 are freely seated around the outer circumferential surfaces of the annular portions 10*a* and 10*b*, the deformation of the flexible perforated sheet from the condition shown in FIG. 4*a* to that shown in FIG. 4*b* occurs lightly and quickly, so that the bulging out deformation of the flexible perforated sheet can lightly and quickly follow the relative shifting of the internal press roller against the flexible perforated sheet due to a rotation of the printing drum.

FIGS. 5*a* and 5*b* are views similar to FIGS. 4*a* and 4*b*, showing another embodiment of the present invention modified from that shown in FIGS. 4*a* and 4*b*. In FIGS. 5*a* and 5*b*, portions corresponding to those shown in FIGS. 4*a* and 4*b* are designated by the same reference numerals as in FIGS. 4*a* and 4*b*. In the embodiment shown in FIGS. 5*a* and 5*b*, cushion elements 30 formed from a highly elastic sheet made of foamed elastic resins or the like are each provided in the clearances 28 between the opposite side edge portions of the flexible perforated sheet 20 and the outer circumferential surfaces of the annular portions 10*a* and 10*b*. By these cushion elements 30 being so provided, when the internal press roller 3 is at its retreated position as shown in FIG. 5*a*, the clearances 28 between the cylindrical body constructed essentially of the flexible perforated sheet 20 and the annular portions 10*a* and 10*b* are maintained more uniformly over the entire circumference of the printing drum. Further, when the cushion elements 30 are made of an appropriate material, they operate effectively to prevent a leaking out of ink from the inside of the printing drum. In order to obtain such a function effectively, the cushion elements 30, when constructed to have a foamed sponge structure, should desirably have a closed independent foam construction not to get impregnated by ink. The cushion elements 30 may be fixed to either the flexible perforated sheet 20 or the annular portions 10*a* and 10*b* by an adhesive or the like.

Even when these cushion elements 30 are so provided, since the cushion elements made of a highly elastically deformable material can readily contract to reduce the thickness thereof according to a compression applied thereto, when a portion of the cylindrical body essentially made of the flexible perforated sheet is bulged radially outwardly by the internal press roller 3 as shown in FIG. 5*b*, the cushion elements readily contract to reduce the thickness thereof at the required portions thereof so as to allow the flexible perforated sheet to deform in the substantially same configuration as in the embodiment shown in FIGS. 4*a* and 4*b*.

FIGS. 6*a* and 6*b* and FIGS. 7*a* and 7*b* are similar views showing a modification of the embodiments shown in FIGS. 4*a* and 4*b* and FIGS. 5*a* and 5*b*, respectively. In these modified embodiments, the opposite end portions 24 and 26 of the flexible perforated sheet 20 are mounted to the transverse bar portion 12 via pivot means 32 and 34, respectively. When the opposite end portions (or at least one end portion) of the flexible perforated sheet are mounted to the frame by means of the pivot means, even when the clearance 28 is very small such as 0.2 mm, the softness of bulging out of the flexible perforated sheet at a portion very close to the transverse bar portion 12 is further increased. The other conditions and operations of the modified embodiments shown in FIGS. 6*a* and 6*b* and FIGS. 7*a* and 7*b* are the same as those of the embodiment shown in FIGS. 4*a* and 4*b* and FIGS. 5*a* and 5*b* .

As will be understood from the foregoing descriptions, in the printing drums shown in FIGS. 4*a*–7*b*, in which the rectangular flexible perforated sheet 20 constructing the flexible cylindrical surface of the printing drum is mounted to the transverse bar portion 12 at the front end 24 and the rear end 26 thereof directly or via the pivot means 32 and 34 in a stationary condition with respect to the circumferential length, the circumferential length of the cylindrical body constructed by the rectangular flexible perforated sheet and the transverse bar portion is constant, with the flexible perforated sheet being in a condition substantially closely seated around the annular portions 10*a* and 10*b* with a very small clearance such as 0.2 mm when any portion thereof is not bulged out by the internal press roller, thereby preventing leaking out of ink through the clearance between the opposite side edge portions of the flexible perforated sheet and the annular portions, while when the pressing action by the internal press roller is applied thereto in the printing operation, the flexible perforated sheet is easily immediately locally bulged out as much as a required amount such as 3 mm. By the opposite ends of the flexible perforated sheet being mounted to the transverse bar portion stationarily with respect to the circumferential length, there is avoided such a phenomenon observed with respect to the construction of the afore-mentioned Japanese Patent Application 1-47029 having the trailing end of the flexible perforated sheet biased toward the transverse bar portion by spring means that the flexible perforated sheet is lifted up from the annular portions by the attraction force applied thereto by a stencil sheet in the process of discharge thereof, the stencil sheet adhering thereto by the viscosity of ink, so that the cylindrical body of the flexible perforated sheet is stably maintained even during the stencil sheet discharging process.

Although in FIGS. 4*a*–7*b* the above-mentioned direct mounting or mounting by a pivot means of the leading end and the trailing end of the flexible perforated sheet to the transverse bar portion is shown such that an end of the flexible perforated sheet expressed by a single line is simply abutted to or connected via a circle expressing the pivoting means to the transverse bar portion for a functional illustration of the construction of the present invention and the clarity of illustration, it will be apparent that these connecting portions may incorporate any mounting construction using fastening screws or hooks for the convenience of mounting and exchanging of the flexible perforated sheet.

FIGS. 8 and 9 are diagmmmatical views corresponding to FIG. 4*a* and FIG. 5*a*, respectively, showing still other embodiments of the present invention. In these embodiments, the cylindrical body essentially made of a flexible perforated sheet is self contained so as to provide the entire circumference by itself without incorporating the transverse bar portion 12 as a part thereof. The portion of the cylindrical body which traverses the transverse bar portion may be closely laid over the outer circumferential surface of the annular portions 10*a* and 10*b* or may be out of contact with the outer circumferential surface of the annular portions so that the cylindrical body is coaxial with the annular portions over the entire circumference thereof. In any event, such a difference is a matter of the order of 0.2 mm as described above by way of an example. In the embodiment shown in FIGS. 8 and 9 the cylindrical body is shown to be perfectly coaxial with the annular portions. However, the annular clearance in these figures is of course exaggerated for the clarity of illustration.

Although the present invention has been described above in detail with respect to several preferred embodiments thereof, it will be apparent for those skilled in the art that the present invention is not limited to these embodiments and various other embodiments are possible within the scope of the present invention.

We claim:

1. In a rotary type stencil printer including a printing drum having a generally cylindrical configuration with opposite ends and perforated at a central circumferential area thereof, an internal press roller disposed in said printing drum, means for mounting said internal press roller to be selectively pressed against said printing drum from the inside thereof radially outwardly, and a back press means opposing said printing drum from the outside thereof along a generatrix thereof with a clearance left therebetween, said stencil printer carrying out a stencil printing to apply a stencil print on a print sheet supplied between said printing drum and said back press means with a flexible perforated stencil sheet mounted around said printing drum and an ink supplied to the inside of said printing drum and squeezed by said internal press roller into the perforations of said printing drum with a simultaneous bulging out of a portion of said printing drum opposing said back press means so as thereby to cancel said clearance, said printing drum comprising:

(a) a frame body including two annular portions each having an outer circumference of a predetermined first circumferential length which provide said opposite ends of said printing drum;

(b) a transverse bar portion connecting said two annular portions with one another, said transverse bar portion having a stencil sheet leading end mounting means for holding a leading end of a stencil sheet so that said stencil sheet will be mounted around said printing drum; and (c) a flexible perforated sheet of a rectangular configuration when developed to a plane configuration but rounded to provide a part of a cylindrical body defining said cylindrical configuration of said printing drum such that a strip portion of said cylindrical body along a generatrix thereof is provided by said transverse bar portion while said part of the cylindrical body provided by said flexible perforated sheet is the remaining part of the cylindrical body;

the arrangement being such that said flexible perforated sheet and said transverse bar portion are circumferentially connected in series, with opposite side edge portions of said flexible perforated sheet being freely seated on outer circumferential surfaces of said two annular portions of said frame body, wherein the circumferential length of the inside circumference of said cylindrical body is greater than the circumferential length of the outer circumferential surfaces of said annular portions of said frame body by an amount sufficient to provide a space between said cylindrical body and said annular portion for at least part of said circumferential distance so as to provide said bulge out of the portion of said printing drum opposing said back press means by said internal press roller to cancel said clearance during the printing operation of the stencil printer.

2. A printing drum according to claim 1, wherein said flexible perforate sheet is pivotally mounted with said transverse bar portion.

3. A printing drum according to claim 1, further comprising a cushion element inserted between each of said opposite side edge portions of said flexible perforate sheet and the outer circumferential surface of a corresponding one of said two annular portions of said frame body.

* * * * *